United States Patent [19]

Yamamoto

[11] Patent Number: 4,896,637

[45] Date of Patent: Jan. 30, 1990

[54] POWER SUPPLY DEVICE FOR ELECTRICAL EQUIPMENT OF AN AUTOMOTIVE VEHICLE

[75] Inventor: Kyohei Yamamoto, Himeji City, Japan

[73] Assignee: Mitsubishi Denki Kabushiki Kaisha, Tokyo, Japan

[21] Appl. No.: 280,464

[22] Filed: Dec. 6, 1988

[30] Foreign Application Priority Data

Dec. 15, 1987 [JP] Japan ..... 62-191053[U]

[51] Int. Cl.[4] ..... F02N 11/08

[52] U.S. Cl. ..... 123/179 B; 123/179 R; 290/38 R; 307/10.6

[58] Field of Search ..... 123/179 B, 179 R; 290/38 R, 50; 307/10.6

[56] References Cited

U.S. PATENT DOCUMENTS 4,754,730 7/1988 Campagna ..... 123/179 B

FOREIGN PATENT DOCUMENTS 2245860 4/1975 France ..... 123/179 B 55-106434 7/1980 Japan .

*Primary Examiner*—Andrew M. Dolinar

*Attorney, Agent, or Firm*—Sughrue, Mion, Zinn, Macpeak and Seas

[57] ABSTRACT

A power supply device for an engine starter of an automobile is disclosed. The device comprises a control circuit which controls the supply of DC current from a battery to the starter by making and breaking the electromagnetic switch of the starter. A series circuit of a starting switch and a DC-DC converter is coupled across a positive terminal of the battery and the input of a constant voltage source circuit. The output voltage of the DC-DC converter is 1.5 times as great as the input. Further, a diode is coupled in parallel with the series circuit of the starting switch and the DC-DC converter to supply the battery voltage when the starting switch is opened. The control circuit of the starter having input terminals coupled to the starting switch and an engine rotation sensor is supplied with the constant operating voltage from the constant voltage source circuit. The output of the control circuit operates a relay which in its turn operates the electromagnetic switch of the starter.

9 Claims, 4 Drawing Sheets

POWER SUPPLY DEVICE FOR ELECTRICAL EQUIPMENT OF AN AUTOMOTIVE VEHICLE

BACKGROUND OF THE INVENTION

1. Field of the Invention

The present invention relates to a power supply device for electric equipment of an automotive vehicle, such as an engine starter.

2. Description of the Prior Art

FIG. 1 shows a conventional power supply device for an engine starter as an example of a power supply device for electric equipment of an automobile. The power supply device comprises a battery 1 coupled to a starter 2 and a switch 3 at the positive terminal thereof. The battery 1 is grounded at the negative terminal thereof. The starter 2 comprises an electromagnetic switch 21 and a starter motor 22. A fixed contact 21*a* of the switch 21 is coupled to the positive terminal of the battery 1, while the other fixed contact 21*b* is coupled to a field magnet coil 22*a* of the motor 2. A movable contact 21*c* is moved by an excitation coil 21*d* coupled to a relay 9. The armature 22*d* of motor 2 is supplied with electric current through a brush 22*b* coupled to the field magnet coil 22*a* and a grounded brush 22*c*. A constant voltage source circuit 6 coupled to the battery 1 at the positive terminal thereof supplies an operating voltage of perdetermined level to a control circuit 7, which, in response to a starting signal from the switch 3 and an engine rotation signal from an engine rotation sensor 8, controls the making and breaking of relay 9, which includes a relay coil 9*a* and a usually open conact 9*b* operated by it.

The operation of the device of FIG. 1 is as follows. When the starter switch 3 is made, control circuit 7 supplies a voltage to relay coil 9*a*, thereby closing the contact 9*b* to apply the battery voltage E to the excitation coil 21*d*. Thus, the movable contact 21*c* comes into contact with the fixed contacts 21*a* and 21*b* to supply the battery voltage E to the starter motor 22. When the starter motor 22 has started the associated engine, the rotation sensor 8 generates a rotation signal, and in response thereto, control circuit 7 stops supplying a voltage to the relay coil 9*a* to open the contact 9*b*. As a result, the electromagnetic switch 21 is opened and the starter 2 is stopped.

The conventional power supply device shown in FIG. 1 has following disadvantages. Namely, the voltage E across the positive and negative terminals of the battery 1 varies as shown in FIG. 2: When the switch 3 is made to supply voltage E to the starter 2 at a time point A, a rush current flowing through the starter 2 causes the battery voltage E (which has been at a constant rated voltage E0 before time point A) to fall abruptly to a minimum E1 at a time point B. Thereafter, the voltage E gradually increases as the rotational speed of the starter increases. The voltage drop (E0–E1) due to the rush current is especially severe when the ambient temperature is low: In such cases, the minimum voltage E0 may become as low as 4 V. On the other hand, IC (integrated circuit), etc., utilized in control circuit 7 generally operates at a voltage level of about 5 V. Thus, constant voltage source circuit 6 is designed to apply 5 V to control circuit 7 when it is in proper operation. To maintain the output voltage of constant voltage source circuit 6 at 5 V, the input voltage supplied thereto should be kept within the range of from 6 to 20 V. Thus, when the minimum voltage E0 becomes lower than the lower limit (i.e. 6 V) of the acceptable input voltage range (i.e., 6 to 20 V) of constant voltage source circuit 6, the output voltage thereof applied to control circuit 7 becomes lower than the operating voltage (5 V) of control circuit 7. As a result, relay 9 is turned off before the enginne is started. If this happens, it becomes impossibe to start the engine.

In view of the disadvantage of the conventional power supply device of FIG. 1, Japanese laid-open patent application No. 59-155550 proposes to suppress the operation of the control circuit for a predtermined time interval during the starting of the engine, for the purpose of preventing the above-mentioned malfuctioning of the control circuit which may be caused by the lowering of the battery voltage. This suppression of the control circuit, however, results in a loss of control of the power supply circuit, even if for a short period during the starting of the engine. Thus, troubles may ensue in this period.

Alternatively, provision of a back-up battery or a capacitor of a large capacity for supplying the control circuit with power may be contemplated for the purpose of compensating for the lowering of the battery voltage at the starting of the engine. These measures, however, also have problems with regard to maintenance and durability thereof.

SUMMARY OF THE INVENTION

Thus, a main object of the present invention is to provide a power supply device for electrical equipment of an automobile, such as an engine starter, wherein malfunctioning of the control circuit due to a rush current of the electrical equipment (e.g. the rush current flowing through the engine starter when the engine is started) can be effectively prevented.

A further object of the present invention is to provide such a power supply device which can be produced and maintained economicaly.

A still further object of the present invention is to provide such a power supply device which has an enhanced durability.

According to the present invention, a power supply device is provided which includes a battery for supplying a DC voltage to an electric device of an automobile which includes a switching means. For example, the power supply device supplies a DC voltage to an engine starter which includes an electromagnetic switch for making and breaking the current supplied from the battery to the starter motor. The input of a voltage raising circuit means, e.g., a DC-DC converter, of the power supply device is coupled to a terminal of the battery through a starting switch which is in series circuit relationship with the voltage raising circuit means. The output of the voltage raising circuit means, on the other hand, is coupled to the input of a constant voltage source circuit, which, in its turn, supplies a constant operating voltage to a control circuit controlling the making and breaking of the switching means of the electric device. Further, a diode is coupled in parallel with the series circuit of the starting switch and the voltage raising circuit means, to supply the battery voltage to the constant voltage source circuit when the starting switch is opened.

Thus, even if the battery voltage goes below the lowest allowable input voltage level of the constant voltage source circuit due to a rush current flowing through the electric device of an automobile upon starting thereof, the voltage raising circuit means supplies to the constant voltage source circuit a voltage which is above the lowest allowable input level thereof. After the starting switch is opened, the diode supplies to the constant voltage source circuit the battery voltage which is substantially recovered by this time. Consequently, the constant voltage can be stably supplied from the constant voltage source circuit to the control circuit, thereby enhancing the reliability of the power supply device according to the present invention.

BRIEF DESCRIPTION OF THE DRAWINGS

The novel features which are believed to be characteristic of the present invention are set forth with particularity in the appended claims. The present invetnion itself, however, both as to its organization and method of operation, will be best understood from the following detailed description of the preferred embodiments, taken in conjunction with the accompanying drawings, in which:

In the drawings, like reference numerals represent like or corresponding parts or portions.

DETAILED DESCRIPTION OF THE PREFERRED EMBODIMENTS

Figure 1:
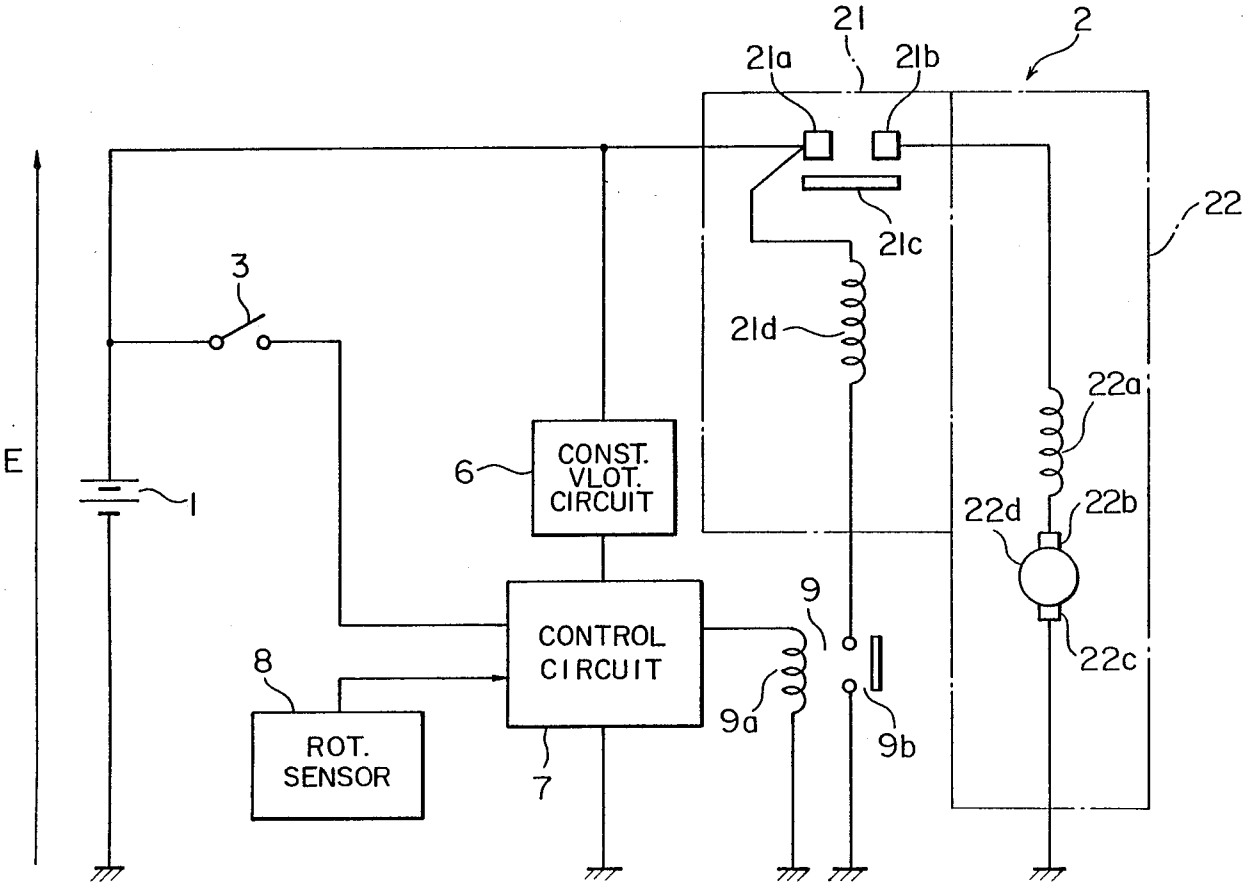
FIG. 1 PRIOR ART
FIG. 1 is a circuit diagram of a conventional power supply device for an engine starter of an automobile.
Figure 3:
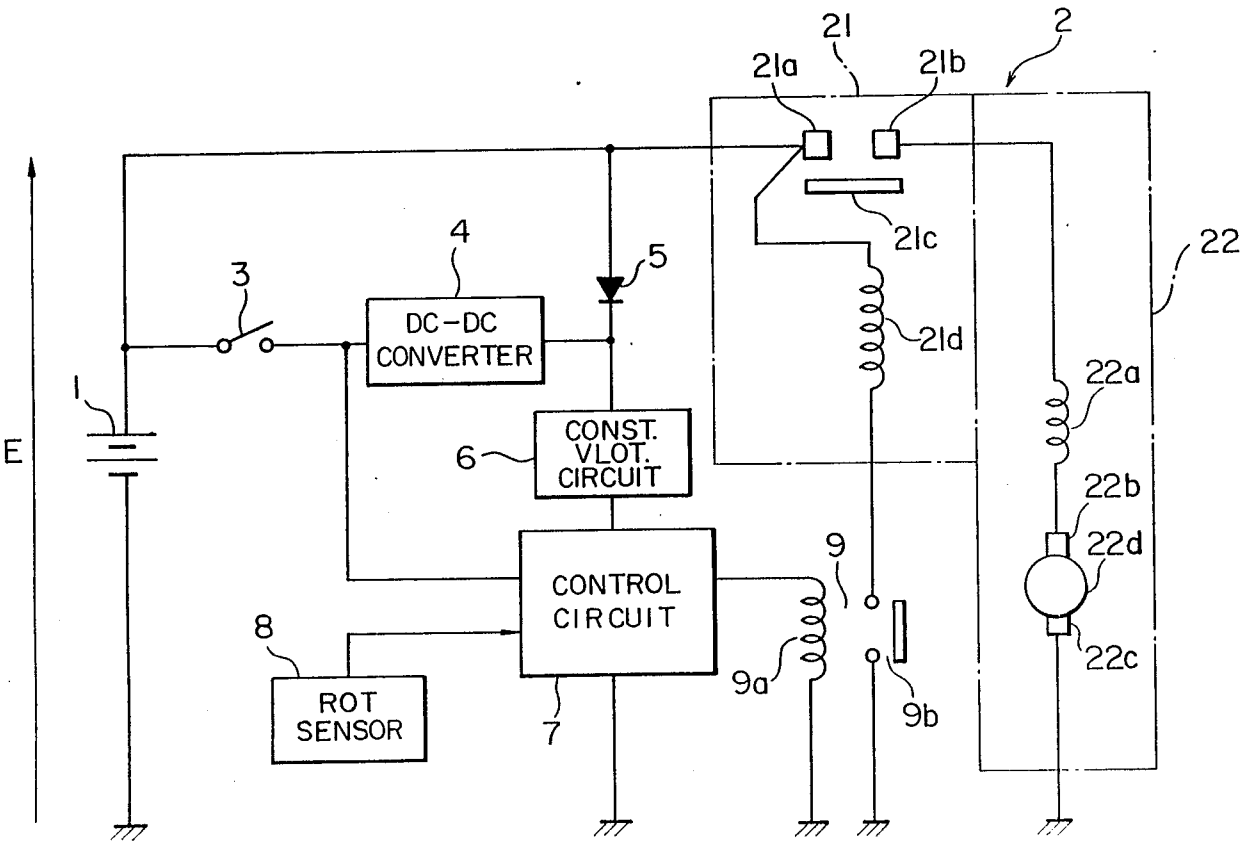
FIG. 3 is a circuit diagram of a power supply circuit for an engine starter of an automobile according to the present invention.

Referring now to FIG. 3 of the drawings, a first embodiment according to the present invention is described. The power supply circuit of FIG. 3 is similar to the circuit of FIG. 1, except for the provision of DC-DC converter 4 and a diode 5 coupled to the input of the constant voltage source circuit 6. Thus, a positive terminal of battery 1 is coupled, through a switch 3, to a starting signal input terminal of a control circuit 7 and to an input terminal of of a DC-DC converter 4 which is well known in the art and which constitutes a voltage raising circuit means according to the present invention. The output terminal of DC-DC converter 4 is coupled to constant voltage source circuit 6 having an output terminal coupled to the operating voltage input terminal of control circuit 7. Further, a diode 5 is coupled across the positive terminal of battery 1 and the input terminal of constant voltage source circuit 6 in parallel circuit relationship with the series circuit of the starting switch 3 and DC-DC converter 4, the forward direction of diode 5 coinciding with the current from the positive terminal of battery 1 to the input of circuit 6. The output of an engine rotation sensor 8 is coupled to an engine rotation signal input of control circuit 7 having a gounded terminal. An output terminal of control circuit 7 is coupled to a relay coil **9*a* of a relay 9 having a usually open contact 9*b*. The engine starter 2 supplied and controlled by the power supply circuit as described above comprises an electromagnetic relay switch 21 and a DC electric motor 22. Switch 21 includes fixed contacts 21*a* and 21*b* coupled to the positive terminal of battery 1 and a field magnet coil 22*a* of motor 22, respectively. Switch 21 further includes a movable or armature contact 21*c*, and an excitation coil 21*d* for making the contact 21*c*. On the other hand, motor 22 comprises, in addition to field magnet coil 22*a*, a brush 22*b* coupled to field magnet coil 22*a*, a grounded brush 22*c*, and an armature 22*d* supplied from brushes 22*b* and 22*c***.

Figure 2:
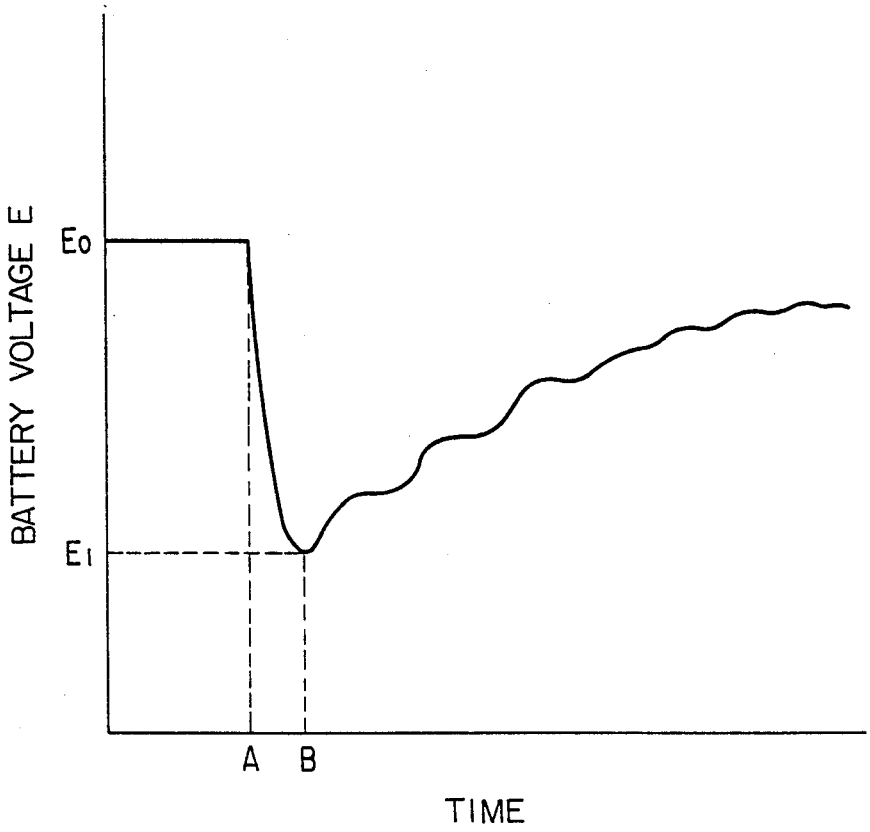
FIG. 2 is a graph showing the variation of the battery voltage of a power supply device for an engine starter before and after the engine is started.

The operation of the circuit of FIG. 3 is as follows. When the switch 3 is made, control circuit 7 makes the contact **9*b* of relay 9 by energizing the coil 9*a* in response to the starting signal applied thereto through starting switch 3 in the form of the battery voltage E. Thus, the coil 21*d* is energized to make the contact 21*c*, thereby starting the motor 22. Thereupon, as shown in FIG. 2, due to the rush current through the motor 22, the battery voltage E falls abruptly from the rated voltage E1 to a minimum E0 which may be as low as 4 V. DC-DC converter 4, however, outputs a voltage 1.5 times as great as the input voltage thereof. Thus, even when the battery voltage E drops to about 4 V, the input of constant voltage source circuit 6 is supplied with a voltage within the allowable input voltage range thereof, which is from 6 to 20 V. During the time when the switch 3 is closed, diode isolates the output of converter 4 from the positive terminal of battery 1. On the other hand, when the associated engine (not shown) is started by the motor 22 and switch 3 is opened, the voltage supply to converter 4 is stopped and the output there of drops to zero. Thus, battery voltage E is supplied through diode 5 to constant voltage source circuit 6. Consequently, control circuit 7** is kept on being supplied with a voltage within the operating voltage range thereof.

Figure 4:
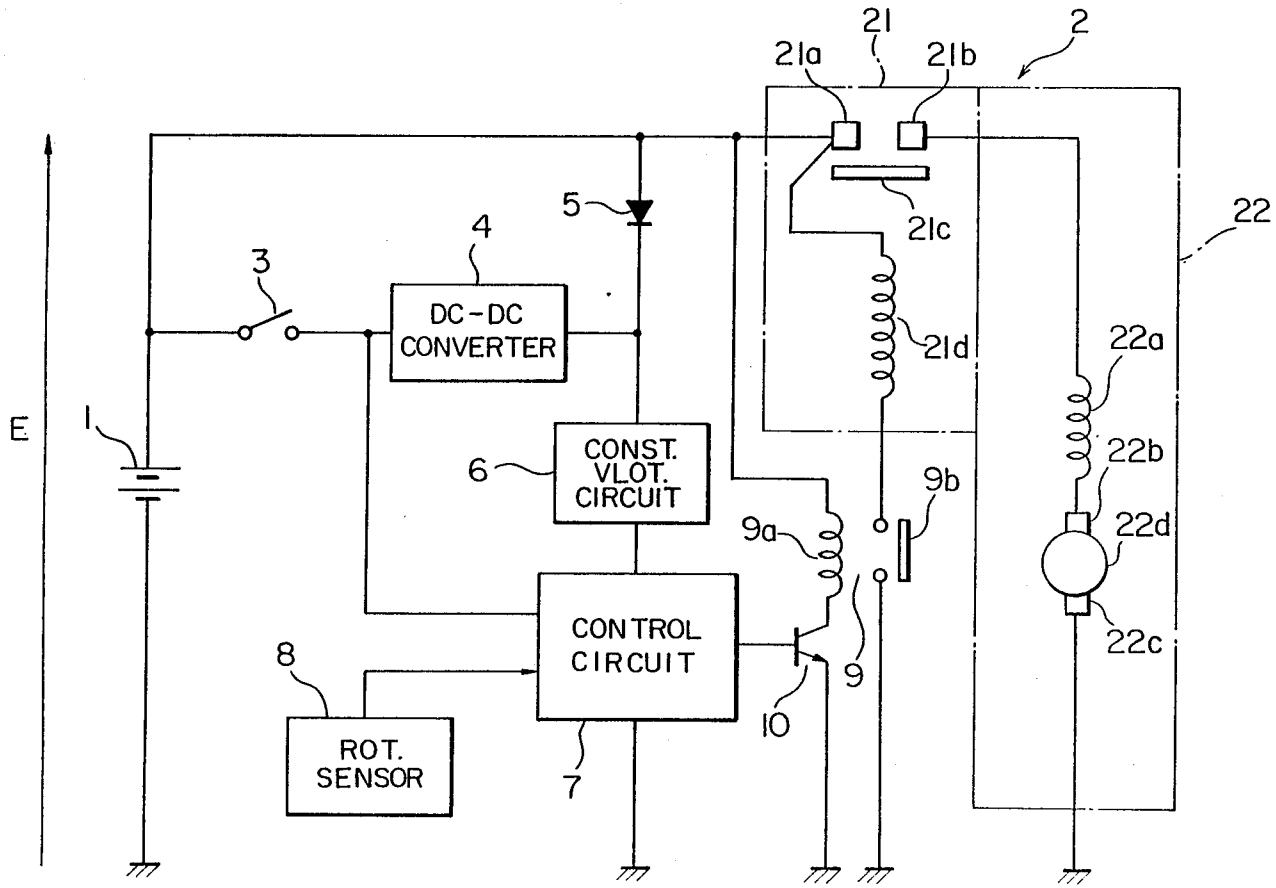
FIG. 4 is a circuit diagram of another power supply circuit for an engine starter of an automobile according to the present invention.

FIG. 4 shows a second embodiment according to the present invention, which is identical with the circuit of FIG. 3 except for the provision of a transistor 10 coupled in series with the relay coil **9*a* of relay 9. In the case of the circuit of FIG. 4, the output of control circuit 7 turns on the transistor 10 in response to the starting signal from switch 3 to energize the coil 9*a*, instead of directly energizing it. Since an output of small current suffices to turn on a transistor, control circuit 7, and hence constant voltage source circuit 6**, can be constituted by a a small-sized and economical circuit of a smaller rating.

While particular embodiments of the present invention have been described above, it will be understood that many modifications may be made without departing from the spirit of thereof. For example, the constant voltage source circuit 6 may be dispensed with to couple the output of the converter 4 directly to the operating voltage input of the control circuit 7 without destroying the function of the power supply circuit. Further, the power supply circuit according to the present invention may be utilized to supply and control an electrical device other than the engine starter, e.g. an ignition system of an automobile, to ensure the stable starting operation thereof. The appended claims are contemplated to cover any such modifications as fall within the true spirit and scope of the present invention.

What is claimed is:

1. A power supply device for an electric device of an automobile having switching means for making and breaking an electric current supplied thereto, comprising:

a battery coupled across said electric device of an automobile having said switching means to supply a DC voltage thereto;

voltage raising circuit means, having an input terminal coupled to a terminal of said battery through a starting switch in series circuit relationship with the voltage raising circuit means, for outputting a DC voltage higher than said DC voltage of said battery;

a diode coupled in parallel circuit relationship with a series circuit of said starting switch and said voltage raising circuit means, a forward direction of said diode coinciding with a forward direction of said voltage raising circuit means;

constant voltage source means having an input terminal coupled to an output of said voltage raising circuit means for outputting a constant DC voltage;

control circuit means coupled to an output of said constant voltage source means to be supplied with said constant DC voltage for outputting a signal controlling a making and breaking of said switching means of said electric device of an automobile.

2. A power supply device as claimed in claim 1, wherein a starting signal input of said control circuit is coupled to said terminal of battery through said starting switch, said control circuit outputting a signal commanding a making of said switching means of said electric device in response to a making of said starting switch.

3. A power supply device as claimed in claim 1, wherein said electric device of an automobile comprises an engine starter and said switching means of the electric device comprises an electromagnetic switch coupled between an electric motor of said engine starter and a terminal of said battery.

4. A power supply device as claimed in claim 3, further comprising relay means, coupled to an output of said control circuit means, for controlling a current through an excitation coil of said electromagnetic switch in response to said output signal of the control circuit means.

5. A power supply device as claimed in claim 4, wherein said relay means comprises:

a relay coil coupled to an output of said control circuit; and a contact operated by said relay coil and coupled in seires with said excitation coil of the electromagnetic switch, a series circuit of said contact and said excitation coil being coupled across said battery.

6. A power supply device as claimed in claim 4, wherein said relay means comprises:

a series circuit of a relay coil and a transistor coupled across said battery, a base of said transistor being coupled to the output of said control circuit means; and a contact operated by said relay coil and coupled in seires with said excitation coil of said electromagnetic switch, wherein a series circuit of said contact and excitation coil are coupled across said battery.

7. A power supply device as claimed in claim 3, wherein an input of said control circuit means is coupled to an engine rotatation sensor, and said control circuit means breaks said electromagnetic switch of said engine starter in response to an engine rotation signal outputted from said engine rotation sensor.

8. A power supply device as claimed in claim 1, wherein said voltage raising circuit means comprises a DC-DC converter.

9. A power supply device for an electric device of an automobile having a switching means for making and breaking an electric current supplied thereto, comprising:

a battery coupled across said electric device of an automobile having said switching means to supply a DC voltage thereto;

voltage raising circuit means, having an input terminal coupled to a terminal of said battery through a starting switch in series circuit relationship with said voltage raising circuit means, for outputting a DC voltage higher than said DC voltage of said battery;

a diode coupled in parallel circuit relationship with a series circuit of said starting switch and said voltage raising circuit means, a forward direction of said diode coinciding with a forward direction of said voltage raising circuit means;

control circuit means, coupled to an output of said voltage raising circuit means to be supplied with said higher DC voltage, for outputting a signal controlling a making and breaking of said switching means of said electric device of an automobile.

* * * * *